US010975513B2

(12) United States Patent
Snook et al.

(10) Patent No.: US 10,975,513 B2
(45) Date of Patent: Apr. 13, 2021

(54) TUB WITH BEARING HOUSING INSERT FOR A LAUNDRY WASHING MACHINE

(71) Applicant: Midea Group Co., Ltd., Shunde (CN)

(72) Inventors: Bryan T. Snook, Louisville, KY (US); Christopher G. Hoppe, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 105 days.

(21) Appl. No.: 15/467,569

(22) Filed: Mar. 23, 2017

(65) Prior Publication Data

US 2018/0274161 A1 Sep. 27, 2018

(51) Int. Cl.

| | |
|---|---|
| ***D06F 37/26*** | (2006.01) |
| ***D06F 34/28*** | (2020.01) |
| ***D06F 37/04*** | (2006.01) |
| *D06F 37/00* | (2020.01) |

(52) U.S. Cl.

CPC ..... *D06F 37/269* (2013.01); *D06F 34/28* (2020.02); *D06F 37/04* (2013.01); *D06F 37/00* (2013.01); *D06F 37/262* (2013.01); *D06F 37/263* (2013.01)

(58) Field of Classification Search

CPC .... D06F 37/262; D06F 37/263; D06F 37/264; D06F 37/269; D06F 39/12

See application file for complete search history.

(56) References Cited

U.S. PATENT DOCUMENTS

| | | | | |
|---|---|---|---|---|
| 2,672,255 | A * | 3/1954 | Mustee | D06F 39/12 220/62.18 |
| 5,373,715 | A | 12/1994 | Sharp et al. | |
| 5,746,070 | A | 5/1998 | Bailey et al. | |
| 6,148,647 | A | 11/2000 | Kabeya et al. | |
| 6,918,271 | B2 | 7/2005 | Lim et al. | |
| 7,862,871 | B2 | 1/2011 | Caudevilla et al. | |
| 8,402,797 | B2 | 3/2013 | Kim et al. | |
| 8,590,347 | B2 | 11/2013 | Mola et al. | |
| 8,621,896 | B2 | 1/2014 | Kim et al. | |
| 8,650,918 | B2 | 2/2014 | McMaster et al. | |
| 8,677,788 | B2 | 3/2014 | Kim et al. | |
| 8,677,789 | B2 | 3/2014 | Gracia Bobed et al. | |
| 8,756,957 | B2 | 6/2014 | Kim et al. | |
| 8,931,312 | B2 | 1/2015 | Chang et al. | |
| 9,212,447 | B2 | 12/2015 | Borque Marquina et al. | |

(Continued)

FOREIGN PATENT DOCUMENTS

| | | |
|---|---|---|
| CN | 1274782 A | 11/2000 |
| CN | 1966818 A | 5/2007 |

(Continued)

OTHER PUBLICATIONS

International Search Report and Written Opinion issued in Application No. PCT/CN2017/102129 dated Nov. 29, 2017.

(Continued)

*Primary Examiner* — Marc Lorenzi

(74) *Attorney, Agent, or Firm* — Middleton Reutlinger

(57) ABSTRACT

A wash tub apparatus and method of manufacturing the wash tub for a laundry washing machine. The wash tub may include a bearing housing shell and a bearing housing insert. The bearing housing insert may include at least one bearing. The bearing housing shell may be overmolded with a plastic portion of the cylindrical tub.

6 Claims, 3 Drawing Sheets

(56) References Cited

U.S. PATENT DOCUMENTS

| | | | | |
|---|---|---|---|---|
| 9,284,676 | B2 | 3/2016 | Choi et al. | |
| 9,376,767 | B2 | 6/2016 | Quandt et al. | |
| 9,394,642 | B2 | 7/2016 | McMaster et al. | |
| 9,447,534 | B2 | 9/2016 | Song et al. | |
| 2002/0194884 | A1 | 12/2002 | Heyder et al. | |
| 2005/0138971 | A1 | 6/2005 | Ozturk et al. | |
| 2007/0068199 | A1 | 3/2007 | Dahlmann et al. | |
| 2007/0074542 | A1 | 4/2007 | Kim | |
| 2007/0125135 | A1 | 6/2007 | Kim et al. | |
| 2008/0110213 | A1 | 5/2008 | Choi et al. | |
| 2008/0178635 | A1 | 7/2008 | Ratfisch | |
| 2009/0113941 | A1 | 5/2009 | Kim | |
| 2010/0192640 | A1 | 8/2010 | Bobed et al. | |
| 2010/0287995 | A1 | 11/2010 | Mancini et al. | |
| 2011/0113833 | A1 | 5/2011 | Marquina et al. | |
| 2012/0007481 | A1* | 1/2012 | Filippetti | D06F 37/26 312/228 |
| 2012/0011899 | A1 | 1/2012 | Kwon et al. | |
| 2012/0240637 | A1 | 9/2012 | Lim et al. | |
| 2014/0076006 | A1* | 3/2014 | Lee | D06F 37/22 68/140 |
| 2015/0322614 | A1 | 11/2015 | Borlin et al. | |
| 2016/0145790 | A1* | 5/2016 | Burgess | D06F 37/267 8/137 |
| 2016/0177487 | A1 | 6/2016 | Erickson et al. | |
| 2018/0080161 | A1 | 3/2018 | Fricke et al. | |
| 2018/0327957 | A1 | 11/2018 | Kim et al. | |

FOREIGN PATENT DOCUMENTS

| | | | | |
|---|---|---|---|---|
| CN | 101608389 | A | 12/2009 | |
| CN | 101903582 | A | 12/2010 | |
| CN | 204803593 | U | 11/2015 | |
| DE | 1885212 | U | 1/1964 | |
| EP | 0219115 | B1 | 10/1996 | |
| EP | 1538252 | A1 | 6/2005 | |
| EP | 1715096 | B1 | 7/2008 | |
| EP | 2248936 | A1 | 11/2010 | |
| EP | 1881100 | B1 | 1/2011 | |
| EP | 2460923 | A2 * | 6/2012 | D06F 37/00 |
| EP | 2460924 | A2 * | 6/2012 | D06F 37/00 |
| EP | 2460924 | A2 | 6/2012 | |
| EP | 3067457 | A1 | 9/2016 | |
| GB | 2157326 | A | 10/1985 | |
| GB | 2189511 | A | 10/1987 | |
| KR | 20080072189 | A | 8/2008 | |

OTHER PUBLICATIONS

International Search Report and Written Opinion issued in Application No. PCT/CN2017/102137, dated Dec. 28, 2017.
U.S. Patent and Trademark Office, Office Action issued in related U.S. Appl. No. 15/467,768 dated Feb. 4, 2019.
U.S. Patent and Trademark Office, Final Office Action issued in related U.S. Appl. No. 15/467,768 dated Jun. 7, 2019.
U.S. Patent and Trademark Office, Corrected Notice of Allowance issued in related U.S. Appl. No. 15/467,768 dated Oct. 23, 2019.
U.S. Patent and Trademark Office, Notice of Allowance issued in related U.S. Appl. No. 15/467,768 dated Aug. 21, 2019.

* cited by examiner

TUB WITH BEARING HOUSING INSERT FOR A LAUNDRY WASHING MACHINE

CROSS-REFERENCE TO RELATED APPLICATION

This application is related to the following application, which is filed on even date herewith and assigned to the same assignees as the present application: U.S. patent application Ser. No. 15/467,768 entitled "Tub for a Laundry Washing Machine." The disclosure of this application is incorporated by reference herein.

BACKGROUND

The present embodiments relate to a wash tub for a laundry washing machine.

Typical wash tubs are over-molded onto a bearing housing. As a result, the wash tub is preset for a particular bearing configuration and/or size drive shaft therethrough and cannot, for example, be adjusted subsequently to a different sized drive shaft. Moreover in some instances, the bearing housing may need to be cleaned and pre-heated prior to being over-molded to maintain the structural integrity therebetween due to the different thermal conductivity and expansion rates of the materials. However, this practice often does not readily accommodate different sizes of drive shafts, and it increases manufacturing cost and time, reduces the speed of delivering model changes (i.e. with various dynamic loading specifications) to the market, and increases retooling costs. Thus, there is a need to streamline manufacture while reducing cost and production time.

SUMMARY

Some embodiments of the invention, for example, may include a method of manufacturing a wash tub for a laundry washing machine comprising the step of manufacturing a first pre-product having a bearing housing shell within a rear wall of a plastic cylindrical tub. In various embodiments, the method may include manufacturing a second pre-product having a bearing housing insert. In some embodiments, the bearing housing insert may include one or more bearings. In addition, in some embodiments, the method may include joining the bearing housing insert of the second pre-product with the bearing housing shell of the first pre-product.

In some embodiments, the method of manufacturing the second pre-product may include inserting one or more bearings into a body of the bearing housing insert. In various embodiments, the method of manufacturing the first pre-product may include overmolding the rear wall of the plastic cylindrical tub onto an outer periphery of the bearing housing shell. Further, in some embodiments, the method of manufacturing the first pre-product may include overmolding a side wall of the plastic cylindrical tub. In various embodiments, the method of joining may include at least one of pressing, gluing, or screwing the bearing housing insert into the bearing housing shell. In some embodiments, the bearing housing shell may be a metallic material. Further, in various embodiments, the method may include installing the first pre-product and the second pre-product into a laundry washing machine housing.

In some embodiments, the method of manufacturing a wash tub for a laundry washing machine may comprise the steps of providing a bearing housing shell. In various embodiments, the method may include overmolding a side wall and a rear wall of a cylindrical tub to the bearing housing shell. In addition, in some embodiments, the method may include providing a bearing housing insert. Further in some embodiments, the bearing housing insert may include one or more bearings. In some embodiments, the method may include inserting the bearing housing insert into the bearing housing shell after overmolding the side wall and the rear wall of the cylindrical tub to the bearing housing shell.

In addition, in various embodiments, the method may include inserting one or more bearings into the bearing housing insert. In some embodiments, the bearing housing shell may be a metallic material. Moreover, in some embodiments, the method of inserting the bearing housing insert into the bearing housing shell may include at least one of pressing, screwing, or gluing the bearing housing insert with the bearing housing shell. In various embodiments, the method may include installing the wash tub into the laundry washing machine. In addition, in some embodiments, the method may include installing a trunnion of a wash drum into engagement with the one or more bearings of the bearing housing insert.

In various embodiments, a wash tub for a laundry washing machine may include a bearing housing shell having an outer periphery and an inner periphery. In some embodiments, the inner periphery may define a first through opening. In addition, in some embodiments, a substantially cylindrical tub may comprise an open front, a rear wall, and a side wall extending between the open front and the rear wall. Further, the rear wall may define a second through opening therein. In various embodiments, the cylindrical tub may be overmolded upon the outer periphery of the bearing housing shell whereby the bearing housing shell may be positioned in the through opening of the rear wall of the cylindrical tub. In some embodiments, a bearing housing insert may have one or more bearings therein. Further, in some embodiments, the bearing housing insert may be inserted into the through opening of the bearing housing shell in the combined bearing housing shell and the cylindrical tub.

In addition, in some embodiments, the bearing housing insert may be at least glued, pressed, or screwed into the bearing housing shell. In various embodiments, the one or more bearings may include a front bearing and a rear bearing. Further, in some embodiments, the bearing housing shell may be a metallic material. Further, the metallic material may be aluminum. Some embodiments may include a wash drum. Moreover, in various embodiments, the wash drum may include a trunnion with a drive shaft. Further, in some embodiments, the wash drum may be positioned within the wash tub and the bearing housing insert receives the drive shaft of the trunnion. In various embodiments, the laundry washing machine may include a laundry washing machine housing. In some embodiments, the wash drum and the wash tub may be coupled to the housing.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques within a front-load residential laundry washing machine 10, such as the type that may be used in single-family or multi-family dwellings, or in other similar applications. However, it will be appreciated that the herein-described apparatus and techniques may also be used in connection with other types of laundry washing machines in some embodiments. For example, they may be used in commercial applications in some embodiments. Moreover, the herein-described apparatus and techniques may be used in connection with other laundry washing machine configurations. For example, a top-load laundry washing machine that includes a top-mounted door in a cabinet or housing that provides access to a vertically-oriented wash tub housed within the cabinet or housing may be used. Implementation of the herein-described apparatus and techniques within a top-load laundry washing machine would be well within the abilities of one of ordinary skill in the art having the benefit of the instant disclosure, so the invention is not limited to the front-load implementation discussed further herein.

Figure 1:
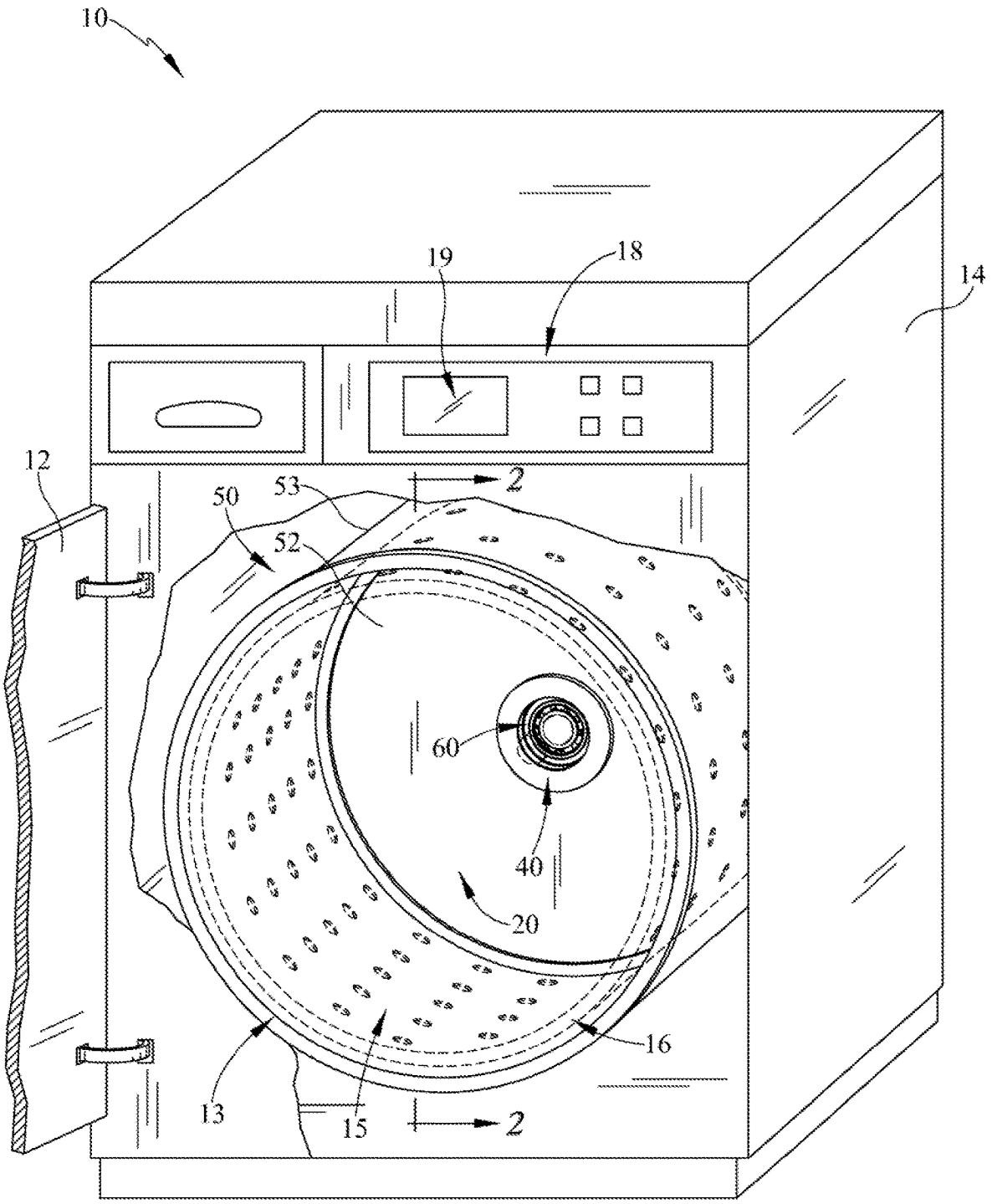
FIG. 1 is a perspective view of one embodiment of a wash tub with portions of an embodiment of the laundry washing machine broken away, illustrating the wash drum in broken lines.

Turning now to the drawings, wherein like numbers denote like parts throughout the several views, FIG. 1 illustrates an example laundry washing machine 10 in which the various technologies and techniques described herein may be implemented. Laundry washing machine 10 is a front-load washing machine, and as such includes a front-mounted door 12 in a cabinet or housing 14 defining an opening 13 that provides access to a horizontally-oriented wash drum or basket 16 and wash tub 20 housed within the cabinet or housing 14. Door 12 is generally hinged along a side or front edge and is pivotable between the open position illustrated in FIG. 1 and a closed position (not shown). When door 12 is in the opened position, clothes and other washable items may be inserted into and removed from the wash chamber 15 within the wash drum 16 (shown in broken lines) through the opening 13 in the front of cabinet or housing 14. The wash tub 20 houses the wash drum 16 that includes a plurality of perforations 11. In some embodiments, a drive mechanism rotates the wash drum 16 via a trunnion 17 relative to the wash tub 20, wherein a liquid may be circulated within the wash tub 20, and thereby the wash drum 16, with an amount of liquid to at least partially submerge the fabric load. Rotation of the wash drum 16 imparts mechanical energy to the liquid and to the fabric articles to move the articles within the wash chamber. The wash chamber 15 defines a wash capacity or volume.

Control over the laundry washing machine 10 by a user is generally managed through a control panel 18. The control panel 18 may be disposed on one or more surfaces of the machine 10 and implementing a user interface 19. It will be appreciated that in different washing machine designs, control panel 18 may include various types of input and/or output devices, including various knobs, buttons, lights, switches, textual and/or graphical displays, touch screens, etc. through which a user may configure one or more settings or cycles.

As is shown in the figures, a bearing housing shell 40 may be overmolded with at least a portion of the plastic cylindrical tub 50 to be used subsequently with one or more insertable sections, or bearing housing inserts 60, having different sizes and configurations of bearings for a variety of applications. The use of a variety of bearing housing inserts 60 may allow the molded plastic cylindrical tub 50 and bearing housing shell 40 to accommodate different sizes or configurations of drive shafts 17*a* of the trunnion 17. Moreover in some embodiments, this may be advantageous to reduce tooling costs, reduce the costs of bearings and drive shafts when spin load requirements are reduced (i.e. such as when using balance rings), and speed up the process of introducing new models with different dynamic loading specifications to the market. Moreover, utilizing a single mold for the plastic tub, or portions thereof, may be more economical while also having the ability to use different sizes of main drive shafts.

Figure 2:
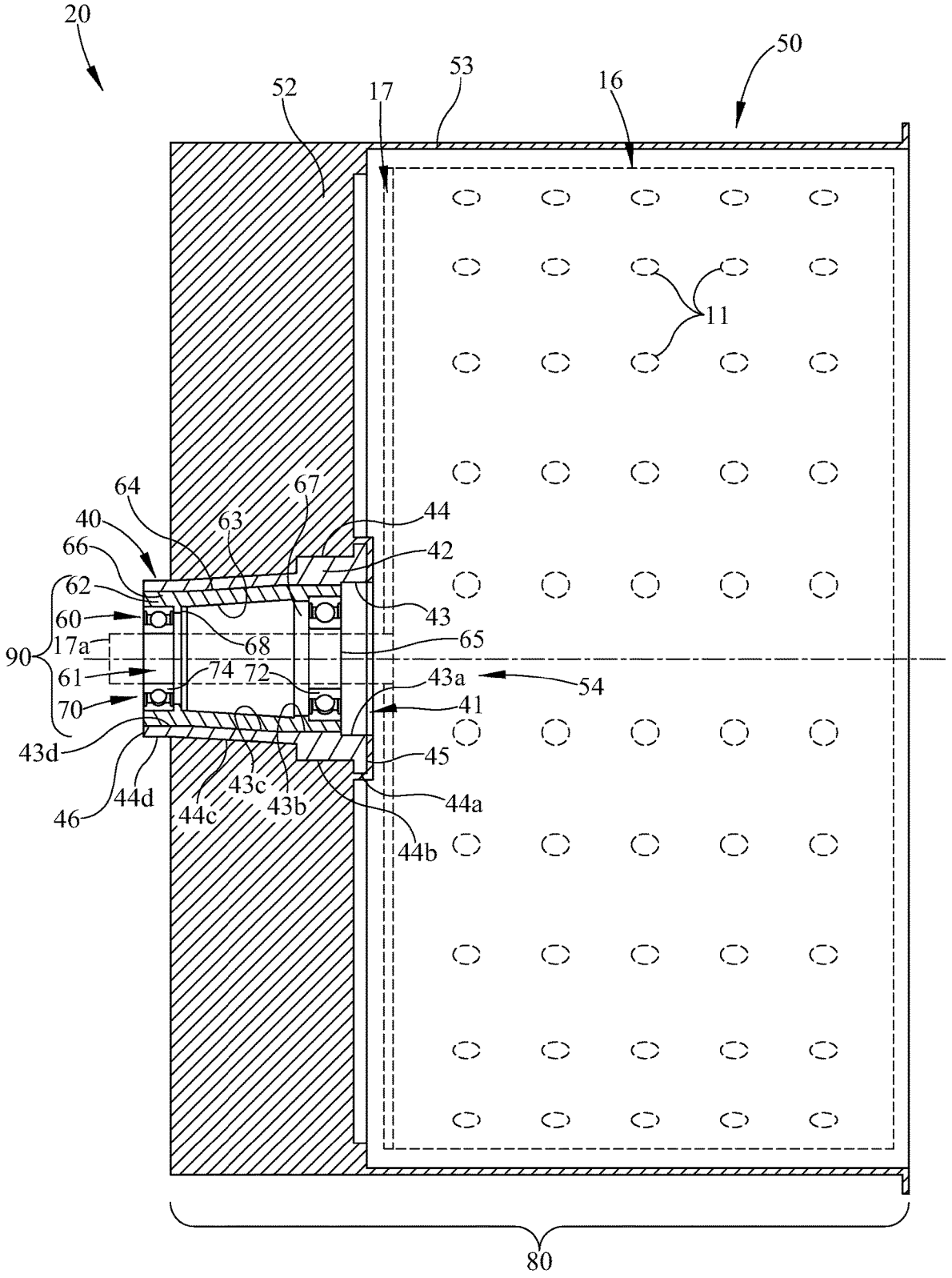
FIG. 2 is a side section view of the wash tub of FIG. 1 taken along line 2-2, illustrating the wash drum in broken lines.

FIGS. 1 and 2 illustrate one embodiment of an assembled wash tub 20 having at least the plastic cylindrical tub 50, bearing housing shell 40, and the bearing housing insert 60 to position the rotatable wash drum 16 therein. The wash tub 20 includes an embodiment of a bearing configuration with one or more bearings 70 to support the drive shaft 17*a* of the trunnion 17 extending through a rear wall 52 of the plastic cylindrical tub 50.

Figure 3:
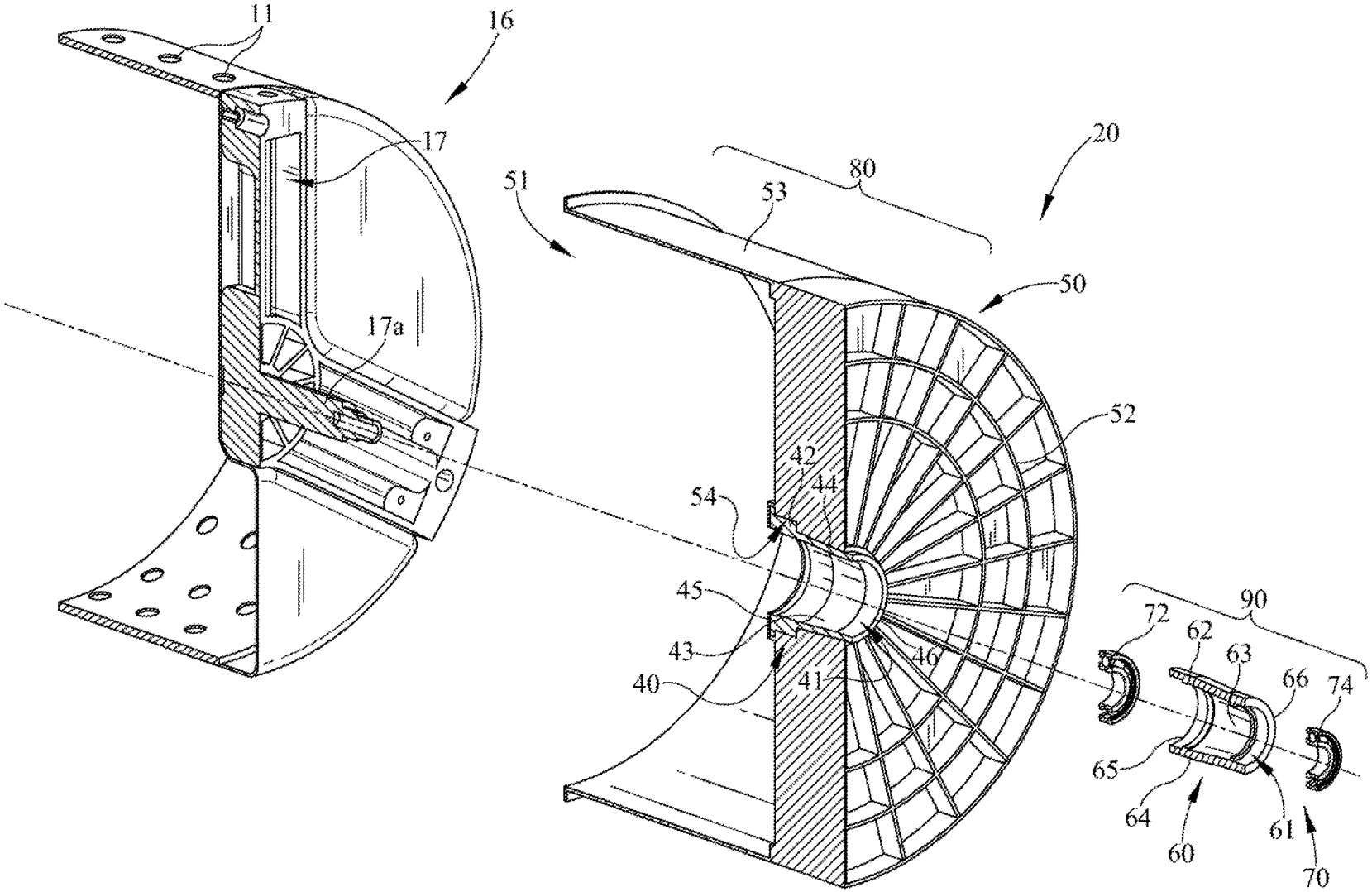
FIG. 3 is an exploded, perspective section view of one embodiment of the wash tub of FIG. 1, illustrating the bearing housing insert and the wash drum exploded from the overmolded bearing housing shell.

As shown in FIGS. 2 and 3, one embodiment of the bearing housing shell 40 may be a body or member 42 having an inner periphery 43 and an outer periphery 44 extending between a front end 45 and rear end 46. The inner periphery 43 of the bearing housing shell 40 at least partially defines a first through opening 41 extending between the front end 45 and the rear end 46. The inner periphery 43 may define a first through opening 41 adapted to receive the bearing housing insert 60. The outer and inner peripheries 44 and 43, respectively, may be of a variety of shapes, sizes, constructions, etc. In the embodiment shown, the outer periphery 44 is shown as having four outer surfaces or tiers, 44*a*-44*d*, each decreasing in diameter from the front end 45 to the rear end 46. Outer surface 44*c* may narrow in diameter towards the rear end 46. The inner periphery 43 as shown in one embodiment includes four inner surfaces or tiers, 43*a*-43*d*, that decrease in diameter from the front end 45 to the rear end 46. Inner surface 43*d* may narrow in diameter towards the rear end 46. The thickness between the inner and outer peripheries, 43 and 44, may vary depending on the application. The bearing housing shell 40 may be made from a metallic material, such as but not limited to aluminum, but other materials or combinations of materials are contemplated. Although an embodiment of the bearing housing shell 40 is shown in the figures, it should be understood that the bearing housing shell may be of a variety of shapes, sizes, quantities, and constructions.

As shown in the figures, one embodiment of the cylindrical tub 50 may be overmolded on the bearing housing shell 40. The bearing housing shell 40 is formed as a unit with the cylindrical tub 50 by inserting material in the injection molding of the tub of plastic about the bearing housing shell 40. The substantially cylindrical tub 50 may include an open front 51 and an opposing rear wall 52 with a side wall 53 extending between the open front 51 and the rear wall 52. The rear wall 52 positions the bearing housing shell body 42 within a second through opening 54 corresponding to the overmolded bearing housing shell 40. The cylindrical tub 50 may be overmolded or coupled to one or more surfaces or portions of the bearing housing shell 40. In the embodiment shown, the cylindrical tub 50 may be overmolded upon the outer periphery 44 of the bearing housing shell. This may include outer surfaces 44*a*-44*c* in some embodiments. Moreover, the cylindrical tub 50 may be overmolded on the front end 45 of the bearing housing shell 40 as is shown in some embodiments. The cylindrical tub 50 may be made from a variety of materials, such as but not limited to, plastic. For example, a portion of the material may be a thermoplastic material in various embodiments such as polypropylene. Although an embodiment of the cylindrical tub 50 is shown in the figures, it should be understood that the cylindrical tub 50 may be of a variety of shapes, sizes, quantities, and constructions. For example, although the cylindrical tub 50 is shown as a single piece that includes the rear wall 52 and side wall 53, the tub may be constructed of one or more separately combined pieces and still be within the scope of the invention (i.e. rear wall overmolded onto the bearing housing shell separate from the side wall).

As illustrated in FIGS. 2 and 3, one embodiment of the bearing housing insert 60 is coupled to the inner periphery 43 of the bearing housing shell 40. The bearing housing insert 60 may be a body or member 62 having an inner periphery 63 and an outer periphery 64. The inner periphery 63 of the bearing housing insert 60 at least partially defines a through hole 61 extending between a front end 65 and a rear end 66. The inner periphery 63 and/or portions of the bearing housing insert 60 may define the through hole 61 adapted to receive the one or more bearings 70. In the embodiment shown, the bearing configuration may include a front bearing 72 and a rear bearing 74 fitted into the inner periphery 63 or circumference of a front step 67 and a rear step 68, respectively, to receive the rotating drive shaft 17*a* coupled to the wash drum 16. The outer periphery 64 of the bearing housing insert 60 conforms to the inner periphery 43 of the bearing housing shell 40. More specifically in one embodiment, the bearing housing insert 60 is coupled to inner surfaces 43*b*-43*d* of the bearing housing shell 40. The bearing housing insert 60 may be of a variety of materials, such as but not limited to metal, polymers, ceramics, etc. One example of the metallic material that may used in some embodiments is cast iron. Although an embodiment of the bearing housing insert 60 is shown in the figures, it should be understood that the bearing housing insert 60 may be of a variety of shapes, sizes, quantities, and constructions. For example in various embodiments, the body 62 of a plurality of bearing housing inserts 60 may have similar outer peripheries 64 such that each can be inserted into the combined bearing housing shell 40 and cylindrical tub 50. However, these bearing housing inserts, with common outer peripheries, may have different shapes, sizes, and constructions (i.e. different inner peripheries) to position a variety of bearing configurations that may be used based on the desired application.

As best illustrated in FIG. 3, a first pre-product 80 can be manufactured for making the wash tub 20. In some embodiments, the first pre-product 80 may include the bearing housing shell 40 and overmolded portions of the plastic cylindrical tub 50. The plastic cylindrical tub 50 is injection molded about the bearing housing shell 40. As illustrated in the one embodiment, the side wall 53 and the rear wall 52 are overmolded onto the bearing housing shell 40. In some embodiments, at least a portion of the rear wall 52 of the plastic tub is injected molded to the bearing housing shell 40 without the side wall 53. A variety of surfaces of the bearing housing shell 40 may be in contact or coupled with the injected plastic. In the one embodiment shown, portions of the front end 45 and/or portions of the outer periphery 44 may be coupled to the injected cylindrical tub 50.

As further illustrated in FIG. 3, a second pre-product 90 may be manufactured for making the wash tub 20. In some embodiments, the second pre-product 90 may include at least the bearing housing insert 60. Moreover, the second pre-product may include inserting the one or more bearings 70 into the body 62 of the bearing housing insert 60. In some embodiments, the second pre-product 90 may not include the bearings 70 such that the bearings are subsequently added after assembly of the first and second pre-products.

As shown in figures, an assembled wash tub 20 according to one embodiment of the invention includes the first pre-product 80 and the second pre-product 90. Assembling the first pre-product 80 and the second pre-product 90 may include joining the bearing housing insert 60 of the second pre-product 90 with the bearing housing shell 40 and cylindrical tub 50 of the first pre-product 80. The bearing housing insert 60 may be pressed, glued, and/or screwed, etc. into engagement with the bearing housing shell 40 previously overmolded with the plastic tub. It is preferred that the bearings 70 be inserted into the second pre-product 90. However it should be understood that the one or more bearings 70 may be inserted into the bearing housing insert 60 after joining with the second pre-product 90 with the first pre-product 80. As shown in FIGS. 1-3, the first and/or second pre-products 80 and 90 of the wash tub 20 may be stocked and/or further combined with or installed into the wash drum 16 and/or the laundry washing machine housing 14.

Moreover as should be understood, the first pre-product 80 and/or the second pre-product 90 may be stocked and/or used directly in the laundry washing machine or assembly 10 in some embodiments. With a variety of first pre-products 80 stocked (i.e. a mold of the cylindrical tub 50), one embodiment of the second pre-product 90 or bearing housing insert 60 may be assembled for a particular application with one or more configurations of bearings depending on the particular application (i.e. to accommodate a size of a drive shaft). Moreover, one or more embodiments of the second pre-product 90 or bearing housing insert 60 may have a different configuration of bearings 70 for another or different sized drive shaft 17*a*. As such in some embodiments, the body 62 of the bearing housing insert 60 (i.e. a universal body) may be stocked and subsequently reconfigured with a variety of bearing configurations and/or sizes of bearings 70 as desired for a particular application of the wash tub 20 or laundry washing machine 10.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A method of manufacturing a wash tub for a laundry washing machine comprising the steps of:

manufacturing a first pre-product having a bearing housing shell within a rear wall of a plastic cylindrical tub, wherein the bearing housing shell includes an inner periphery and an outer periphery, the inner periphery at least partially defines a through opening extending between a front end and a rear end of the bearing housing shell, the outer periphery of the bearing housing shell includes four outer surfaces decreasing in diameter from the front end towards the rear end, and wherein the bearing housing shell is made of aluminum;

manufacturing a second pre-product having a bearing housing insert, wherein the bearing housing insert includes a front bearing and a rear bearing fitted into opposing ends of an inner periphery of the bearing housing insert; and inserting the bearing housing insert of the second pre-product along a central axis of the through opening from the front end to the rear end of the bearing housing shell of the first pre-product after manufacturing the first pre-product and the second pre-product.

2. The method of claim 1, wherein the step of manufacturing the first pre-product includes overmolding the rear wall of the plastic cylindrical tub onto the outer periphery of the bearing housing shell.

3. The method of claim 2, wherein the step of manufacturing the first pre-product includes overmolding a side wall of the plastic cylindrical tub.

4. The method of claim 1, wherein the step of inserting includes at least one of pressing, gluing, or screwing the bearing housing insert into the bearing housing shell.

5. The method of claim 1, further comprising the step of installing the first pre-product and the second pre-product into a laundry washing machine housing.

6. The method of claim 1, wherein the inner periphery of the bearing housing shell includes four inner surfaces decreasing in diameter from the front end towards the rear end, and wherein the inner periphery of the bearing housing shell receives an outer periphery of the bearing housing insert.

* * * * *